US008152085B2

(12) United States Patent
Fukuhiro

(10) Patent No.: US 8,152,085 B2
(45) Date of Patent: Apr. 10, 2012

(54) CRUSHER

(75) Inventor: Yasutaka Fukuhiro, Okayama (JP)

(73) Assignee: Koritsu Industries Co., Ltd., Okayama (JP)

( * ) Notice: Subject to any disclaimer, the term of this patent is extended or adjusted under 35 U.S.C. 154(b) by 6 days.

(21) Appl. No.: 12/374,784

(22) PCT Filed: Jul. 19, 2007

(86) PCT No.: PCT/JP2007/064231

§ 371 (c)(1),
(2), (4) Date: Apr. 6, 2009

(87) PCT Pub. No.: WO2008/013091

PCT Pub. Date: Jan. 31, 2008

(65) Prior Publication Data

US 2010/0006683 A1 Jan. 14, 2010

(30) Foreign Application Priority Data

Jul. 25, 2006 (JP) ..... 2006-202050

(51) Int. Cl.
*B02C 13/09* (2006.01)

(52) U.S. Cl. ..... 241/186.3; 241/186.4; 241/285.3

(58) Field of Classification Search ..... 241/189.1, 241/186.2–186.4, 285.3, 185.5, 190
See application file for complete search history.

(56) References Cited

U.S. PATENT DOCUMENTS

| | | | | | |
|---|---|---|---|---|---|
| 553,163 | A * | 1/1896 | Jolicard | 241/52 |
| 1,648,747 | A * | 11/1927 | Stoner | 241/84.2 |
| 1,975,406 | A * | 10/1934 | Reschke | 241/89.3 |
| 2,954,176 | A * | 9/1960 | Cole | 241/186.3 |
| 4,030,672 | A * | 6/1977 | Borgqvist | 241/18 |
| 4,146,184 | A * | 3/1979 | Whitney | 241/73 |
| 4,350,307 | A * | 9/1982 | Olson | 241/81 |
| 4,533,088 | A * | 8/1985 | Lyston | 241/186.3 |
| 4,735,366 | A * | 4/1988 | Hoffmann | 241/36 |
| 5,390,862 | A * | 2/1995 | Eglin | 241/29 |
| 5,472,147 | A * | 12/1995 | Doppstadt | 241/88.4 |
| 5,513,811 | A * | 5/1996 | Phan Hung | 241/189.1 |
| 5,657,933 | A * | 8/1997 | Williams | 241/186.3 |
| 5,695,134 | A * | 12/1997 | Williams | 241/48 |
| 2002/0043580 | A1 * | 4/2002 | Yanase | 241/85 |

FOREIGN PATENT DOCUMENTS

JP 49-45458 4/1974

(Continued)

OTHER PUBLICATIONS

Japanese Examination Report of Japan Application No. 2006-202050, dated Jul. 6, 2009.

*Primary Examiner* — Faye Francis
(74) *Attorney, Agent, or Firm* — J.C. Patents

(57) ABSTRACT

A crusher is provided that can stably crush various information media, such as paper, magnetic recording media including cassette tapes and the like, optical recording media, and substrates, and the like, and has excellent maintainability. Hammer members 29 that extend from a rotation shaft 45 in a radial direction and rotate with a rotation of the rotation shaft 45 are housed in a casing 21 that includes an upper loading opening 22 for loading an object to be crushed and a lower discharge opening 23 for discharging a crushed object. Fixed blades 47 are arranged within the casing 21 on an outer diameter side of the hammer members. The hammer members 29 and the fixed blades 47 crush the object to be crushed when the hammer members 29 are rotated. A guide path 20 that that guides the object to be crushed that is loaded from the upper loading opening 22 into a crushing chamber 26 in which the object to be crushed is crushed by the hammer members 29 and the fixed blades 47 is provided within the casing 21. Guide bodies 75 that lift the object to be crushed towards the crushing chamber 26 side are provided on a downstream side of the guide path 20.

9 Claims, 9 Drawing Sheets

FOREIGN PATENT DOCUMENTS

| | | |
|---|---|---|
| JP | 53-78306 | 7/1978 |
| JP | 2-100647 | 8/1990 |
| JP | 4-0938 | 1/1992 |
| JP | 6-509739 | 11/1994 |
| JP | 07-299371 | 11/1995 |
| JP | 08-084937 | 4/1996 |
| JP | 08-117634 | 5/1996 |
| JP | 8-168684 | 7/1996 |
| JP | 9-57132 | 3/1997 |
| JP | 2001-30209 | 2/2001 |
| JP | 2001-153149 | 6/2001 |
| JP | 2004-230295 | 8/2004 |

* cited by examiner

CRUSHER

TECHNICAL FIELD

The present invention relates a crusher. In particular, the present invention relates to a crusher that can crush various products, such as magnetic tape recording media including cassette tapes and the like, optical recording media, and substrates.

BACKGROUND ART

A crusher is known which includes a casing and a crushing means (Patent Document 1 and Patent Document 2). The casing includes an upper loading opening into which an object to be crushed is loaded, and a lower discharge opening from which a crushed object is discharged. The crushing means is disposed in a crushing chamber within the casing.

In other words, in a crusher described in Patent Document 1, as shown in FIG. 17, a discharge plate 5 is placed in a lower discharge opening 3 of a casing 1. The discharge plate 5 has a plurality of discharge holes 4. A crushing chamber 6 is formed by inner surfaces of the plate 5 and the casing 1. A crushing means 7 is disposed in the crushing chamber 6. The crushing means 7 includes hammer members 9, fixed blades 10, and the like. The hammer members 9 are arranged on a circular rotating plate 8 at a predetermined pitch along a circumferential direction. The fixed blades 10 are fixed onto the inner surface of the crushing chamber 6 (inner surface of the casing 1). The fixed blades 10 are arranged along a circular arc surface corresponding to a circular trajectory followed by the front end edge of the hammer members 9 during rotation.

Therefore, when an object to be crushed is loaded into the upper loading opening 2 of the casing 1 and fed to the crushing chamber 6, as a result of rotation of the hammer members 9, the object to be crushed is crushed by coordinated operation between the hammer members 9 and the fixed blades 10. The crushed object is then discharged outside from the holes on the discharge plate 5 at the lower discharge opening 3.

Patent Document 1: Japanese Patent Application Laid-open No. Heisei 8-117634

Patent Document 2: Japanese Patent Application Laid-open No. 2001-153149

DISCLOSURE OF INVENTION

Problem to be Solved by the Invention

In the crusher shown in FIG. 17 and the like, when a sheet-shaped object, such as paper, is crushed, the sheet-shaped object may attach itself to the inner surface of the crushing chamber 6 when the sheet-shaped object is loaded through the opening 2. In such instances, the hammer members 9 do not come into contact with the sheet-shaped object. Therefore, the object to be crushed cannot be crushed by the coordinated operation between the hammer members 9 and the fixed blades 10.

When the hammer members 9, the fixed blades 10, and the like are used over a long period of time, damage and the like occur, thereby requiring maintenance and replacement. However, maintenance and replacement operations are difficult to perform because the fixed blades 10 are attached to the inner surface of the crushing chamber 6. The hammer members 9 are attached to the circular rotating plate and can be removed from the circular rotating plate. However, operability regarding attachment and detachment of the hammer members 9 is poor because the hammer members 9 are disposed within the crushing chamber 9.

The present invention has been achieved in light of the above-described issues. The present invention provides a crusher that can stably crush various information media, such as paper, magnetic tape recording media, optical recording media, and substrates, and has excellent maintainability.

Means for Solving Problem

In a first crusher of the present invention, hammer members that extend from a rotation shaft in a radial direction and rotate with a rotation of the rotation shaft are housed in a casing. The casing includes an upper loading opening for loading an object to be crushed and a lower discharge opening for discharging a crushed object. Fixed blades are arranged within the casing on an outer diameter side of the hammer members. The hammer members and the fixed blades crush the object to be crushed when the hammer members rotate. An opening that can be opened and closed by opening and closing operations of a lid member is formed on the casing. Plate fitting grooves are also formed on the casing, along a circular arc surface corresponding to a circular trajectory followed by a front end edge of the hammer members during rotation. The fixed blades are attached to a curved holding plate. The curved holding plate is fitted into the plate fitting grooves from the opening.

In the first crusher of the present invention, because the fixed blades are attached to the curved holding plate, handleability of the fixed blades is excellent. Moreover, the curved holding plate can be fitted into the plate fitting grooves. As a result, the fixed blades can be easily mounted on the casing. The plate can be fitted through the opening provided in the casing. When the opening is in a closed state by the lid member, the plate fitted into the plate fitting grooves can be fixed.

In a second crusher of the present invention, hammer members that extend from a rotation shaft in a radial direction and rotate with a rotation of the rotation shaft are housed in a casing. The casing includes an upper loading opening for loading an object to be crushed and a lower discharge opening for discharging a crushed object. Fixed blades are arranged within the casing on an outer diameter side of the hammer members. The hammer members and the fixed blades crush the object to be crushed when the hammer members rotate. A guide path that guides the object to be crushed that is loaded from the upper loading opening into a crushing chamber in which the object to be crushed is crushed by the hammer members and the fixed blades is provided within the casing. Guide bodies that lift the object to be crushed towards the crushing chamber side are provided on a downstream side of the guide path.

In the second crusher of the present invention, when the object to be crushed is loaded from the upper loading opening, the object to be crushed is guided by the guide path and fed to the crushing chamber. At this time, the guide bodies provided on the downstream side of the guide path can lift the object to be crushed towards the crushing chamber side. As a result, the object to be crushed can come into contact with the hammer members.

In the second crusher as well, an opening that can be opened and closed by opening and closing operations of a lid member can be formed on the casing. Plate fitting grooves can also be formed on the casing, along a circular arc surface corresponding to a circular trajectory followed by a front end edge of the hammer members during rotation. The guide bodies can be can be fitted into the plate fitting grooves from the opening. As a result, the guide bodies can be easily mounted on the casing. Moreover, the plate can be fitted through the opening provided in the casing. When the opening is in a closed state by the lid member, the plate fitted into the plate fitting grooves can be fixed.

A curved discharge plate including numerous holes for discharging the crushed object can be placed in the lower discharge opening of the casing. As a result, the crushed object can be discharged outside (below) from the holes in the circular discharge plate.

A plurality of crushing assisting projections can be provided on an inner surface of the lid member. As a result, the object to be crushed collides with the crushing assisting projections when the hammer members rotate, and the object to be crushed is further crushed.

An optimal loading direction into the crushing chamber differs depending on the type of object to be crushed. In other words, because the hammer members rotate around an axial center of the rotation shaft, depending on an angle formed in relation to a tangent of a circular trajectory followed by the front end edge of the hammer members during rotation, the object to be crushed is thrown from the crushing chamber by the rotation of the hammer members. The angle, namely the loading direction, differs depending on the type of object to be crushed. Therefore, a shifting means is preferably provided to switch the loading direction into the crushing chamber depending on the type of object to be crushed that is loaded into the upper loading opening.

The hammer member includes at least a first hammer member a first hammer member having a crushing blade on a front end side, and a second hammer member having a planar hammer section on a front end side and a crushing blade in the center. The first hammer member and the second hammer member can be selectively attached based on the type of object to be crushed. When the first hammer member is used, because the crushing blade is provided on the front end side, a sheet-shaped object can be cut by the crushing blade of the hammer member. When the second hammer member is used, because the planar hammer section is provided on the front end side and the crushing blade is provided in the center, the planar hammer section can shred a plastic block object such as a cassette tape, and the crushing blade in the center can crush the shredded block pieces.

Effect of the Invention

In the crusher of the present invention, the fixed blades and the guide bodies are respectively mounted on the circular holding plates fitted into the plate fitting grooves on the casing. As a result, the discharge plate, and the plates including the fixed blades and the guide bodies can be mounted on the casing. The fixed blades, the guide bodies, and the like can be easily set. Moreover, the plates can be fitted through the opening provided in the casing. When the opening is in the closed state by the lid member, each plate fitted into the plate fitting grooves can be fixed.

Therefore, when the opening is in the open state, the circular holding plates on which the fixed blades and the guide bodies are respectively mounted can be fitted into the plate grooves on the casing. When the lid member is in the closed state, the fixed blades, the guide bodies, and the like can be set at the fixed positions. When the lid member is placed in the open state from the set state, each plate is released from the fixed state. The discharge plate and the plates including the fixed blades and the guide bodies can be removed.

Therefore, maintenance and replacing operations of the fixed blades, the guide bodies, and the like can be performed in a short amount of time and with certainty. The crusher can be used stably over a long period of time, contributing to reduction in running costs.

In particular, the object to be crushed can be lifted towards the crushing chamber side by the guide bodies provided on the downstream side of the guide path, allowing the object to be crushed to come into contact with the hammer members. In other words, the object to be crushed no longer attaches itself to the inner surface of the crushing chamber, even when the object to be crushed is paper and the like. Therefore, the object to be crushed can be stably crushed.

Because the crushed object is discharged outside (below) from the discharge holes in the discharge plate, crushed objects larger than the diameter of the discharge holes are not discharged. The crushed object remains in the crushing chamber and are further crushed by the hammer members and the fixed blades. Therefore, only crushed objects crushed to become smaller than the hole diameter of the discharge holes are allowed to be discharged outside.

Because the object to be crushed is crushed by the hammer members and the fixed blades, crushing can be performed regardless of whether the object to be crushed is soft paper, such as an account book, or a hard substrate. Recording media storing various pieces of information (such as personal information) can be crushed to a non-reproducible state. Moreover, when paper is shredded by an existing shredder, fibers in the paper are finely cut, resulting in poor recyclability. However, when paper is crushed by the crusher of the present invention, the fibers in the paper remain relatively intact. Therefore, recyclability is excellent.

The shifting means can shift the loading direction into the crushing chamber based on the type of object to the crushed that is loaded into the upper loading opening. Therefore, various types of objects to be crushed can be handled by a single crusher. Significant cost reduction can be achieved.

When a plurality of types of hammer members are provided, the hammer members can be interchanged depending on the type of object to be crushed. Therefore, the object to be crushed can be crushed using the optical hammer member for crushing the object to be crushed. Crushing precision of the crusher is enhanced.

Therefore, in the crusher, the object to be crushed can be various objects, such as substrates (substrates mounted on an electrical component and the like), magnetic tape recording media including cassette tapes, optical recording media, and paper. In other words, a single crusher can crush objects ranging from hard objects (such as substrates) to soft objects (such as paper). Therefore, although the crusher to be used is conventionally selected based on the material, shape, hardness and the like of the loaded object to be crushed that is loaded, a single crusher can perform crushing for a wide range of purposes, from hard objects to soft objects, when the crusher of the present invention is used. Therefore, equipment cost can be reduced and running costs can be reduced, thereby reducing overall processing costs. Moreover, excellent protection of personal information and recyclability can be achieved.

BEST MODE(S) FOR CARRYING OUT THE INVENTION

An embodiment of a crusher of the present invention will be described with reference to FIG. 1 to FIG. 16.

Figure 1:
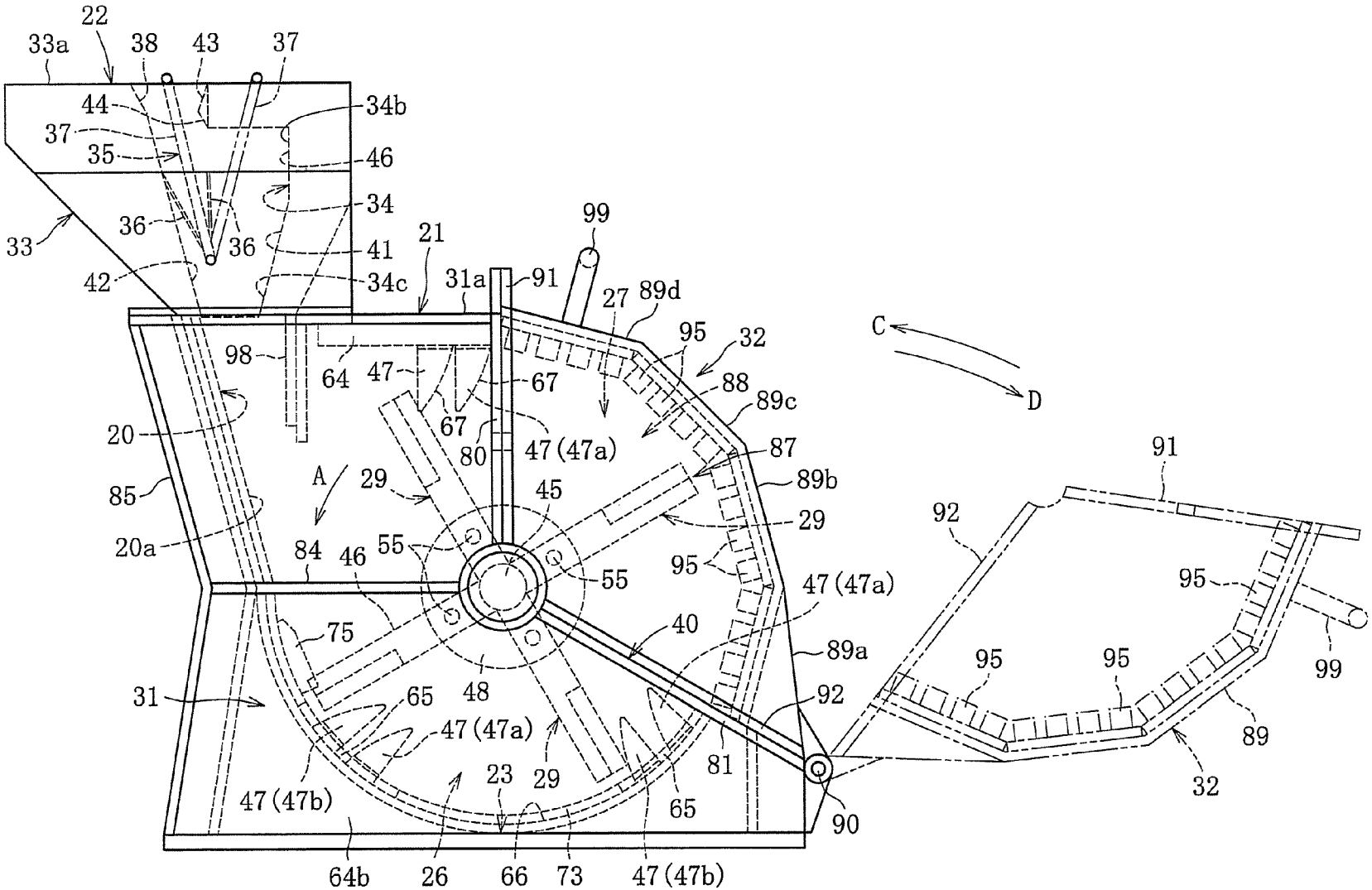
FIG. 1 Diagram of a front view of a crusher according to an embodiment of the present invention.
Figure 2:
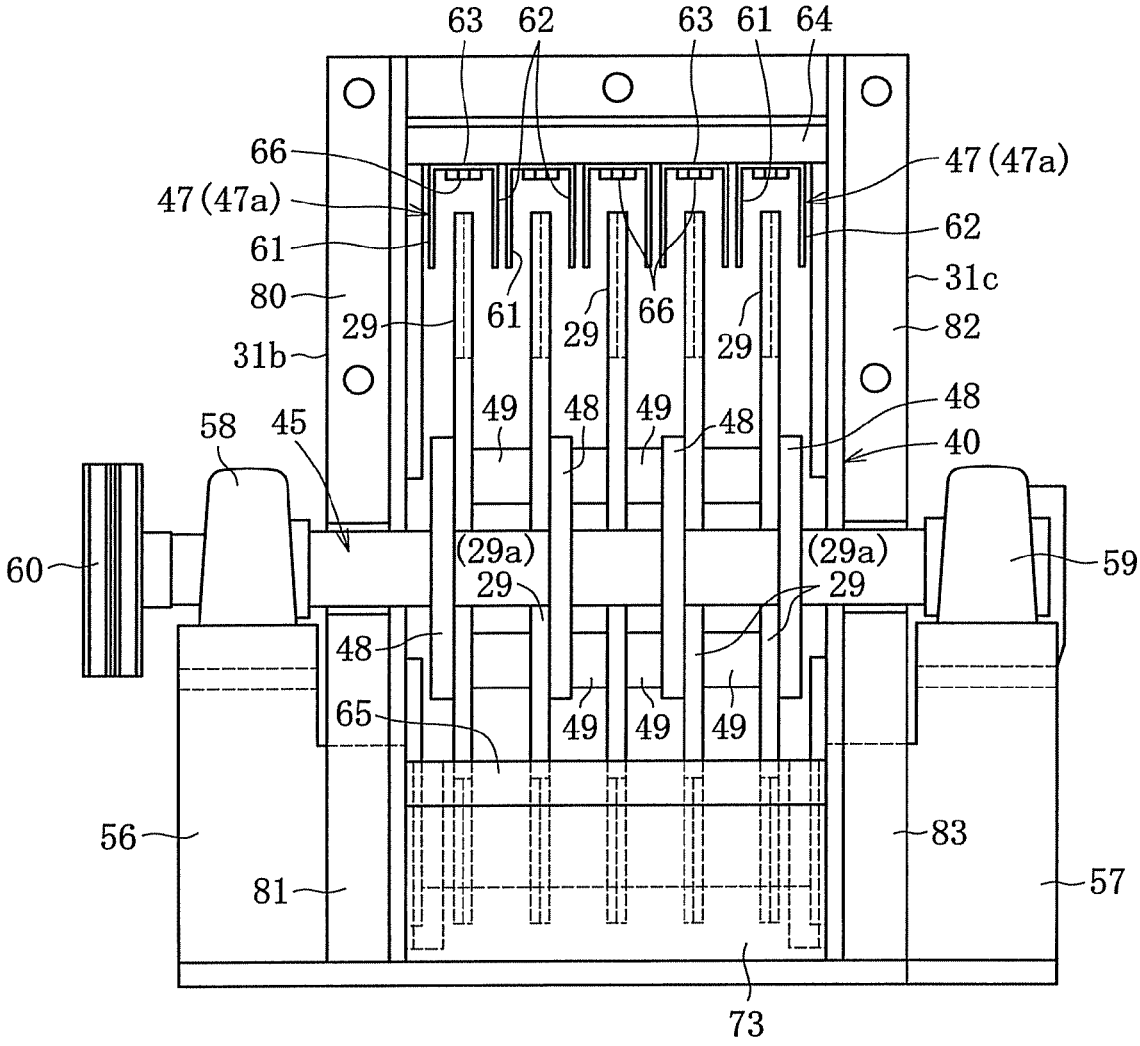
FIG. 2 Diagram of a side view in a state in which a lid member of the crusher is removed.

A crusher using a crusher of the present invention is shown in FIG. 1 and FIG. 2. The crusher includes a casing 21 and a crushing means 27. The casing 21 has an upper loading opening 22 through which an object to be crushed is loaded and a lower discharge opening 23 from which a crushed object is discharged. The crushing means 27 is disposed in a crushing chamber 26 within the casing 21. Objects to be crushed include various products, such as paper, magnetic tape recording media including cassette tapes and the like, optical recording media, and substrates.

The casing 21 includes a casing main body 31 and a lid member 32 that seals an opening (side opening) 40 on the casing main body 31. A hopper 33 for loading the object to be crushed is attached to a top wall 31*a* within the casing main body 31. The upper loading opening 22 is formed on a top wall 33*a* of the hopper 33.

The hopper 33 has a loading path 34 communicating with the upper loading opening 22. The loading path 34 communicates with the crushing chamber 26. A shifting means 35 for shifting a loading direction (feeding direction) to the crushing chamber 26 is provided on the hopper 33. The shifting means 35 includes a shifting plate 36 of which the lower portion is pivotally mounted within the hopper 33. The shifting plate 36 can be shifted between a state indicated by broken lines in FIG. 1 and a state indicated by phantom lines by operation of an operating rod 37.

The loading path 34 includes an upper narrow portion 34*a*, an intermediate wide portion 34*b*, and a lower angled portion 34*c*. The upper narrow portion 34*a* communicates with the upper loading opening 22. The intermediate wide portion 34 communicates with the upper narrow portion 34*a*. The lower angled portion 34*c* communicates with the intermediate wide portion 34. A width dimension of the lower angled portion 34*a* becomes smaller towards the crushing chamber 26. In other words, a wall surface on a counter-lid member side of loading path 34 includes an upper angled surface 38 and a main angled surface 42. The upper angled surface 38 is angled upwards to the counter-lid member side. The main angled surface 42 is angled downwards towards the lid member side. A wall surface of the loading path 34 on the lid member side includes an upper first angled surface 43, an upper second angled surface 44, a vertical surface 46, and a main angled surface 41. The upper first angled surface 43 is angled upwards towards the lid member side. The upper second angled surface 44 is angled downwards towards the lid member side. The main angled surface 41 is angled downwards towards the counter-lid member side. Here, width direction refers to a horizontal direction in FIG. 1. A guide path 20 is provided downstream (lower edge) of the loading path 34. The loading path 34 communicates with the crushing chamber 26 through the guide path 20.

In the state indicated by the broken lines in FIG. 1, the shifting plate 36 is in contact with the main angled surface 42 of the loading path 34. The object to be crushed that is loaded through the loading opening 22 enters the guide path 20, guided by the shifting plate 36. In the state indicated by the phantom lines in FIG. 1, the shifting plate 36 maintains a parallel state with the main angled surface 42 of the loading path 34. The object to be crushed that is loaded through the loading opening 22 passes between the main angled surface 42 of the loading path 34 and the shifting plate 36, and enters the guide path 20.

In other words, in the state indicated by the broken lines in FIG. 1, when the object to be crushed is loaded, the object, guided by the shifting plate 36 and the angled surface 41, enters the crushing chamber 26 along a circular arc tangent formed by the front end edge of hammer members 29, described hereafter, via the guide path 20. In the state indicated by the phantom lines in FIG. 1, when the object to be crushed is loaded, the object enters the crushing chamber 26 along the main angled surface 42 of the loading path 20 and an angled surface 20*a* of the guide path 20. A baffle plate 98 made of an elastic material, such as rubber or resin, hangs from the top wall 31*a* of the casing main body 31.

The crushing means 27 includes a rotation shaft 45, the hammer members 29, and fixed blades 47. The hammer members 29 project from the rotation shaft 45 in a radial direction. The fixed blades 47 are arranged within the casing 21 on an outer diameter side of the hammer members 29. In other words, as shown in FIG. 2, circular plates 48 are provided on the rotation shaft 45, arranged at a predetermined pitch along a longitudinal direction of the rotation shaft 45. A spacer 49 is interposed between the circular plates 48. Each hammer member 29 is sandwiched between a circular plate 48 and the spacer 49. In this state, the rotation shaft 45 and the hammer members 29 are integrated by a bolt and nut connection.

Figure 4:
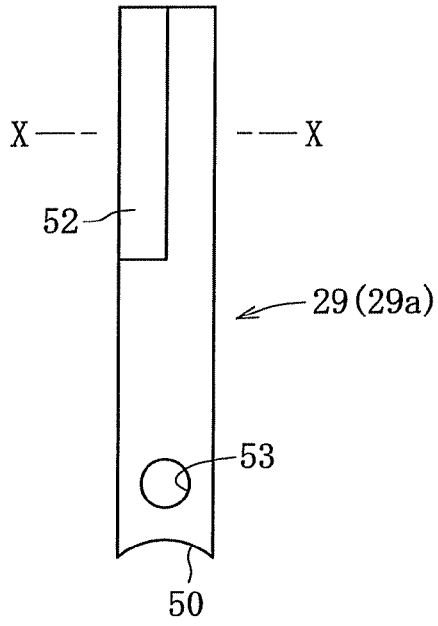
FIG. 4 Diagram of a front view of a hammer member of the crusher.
Figure 5:
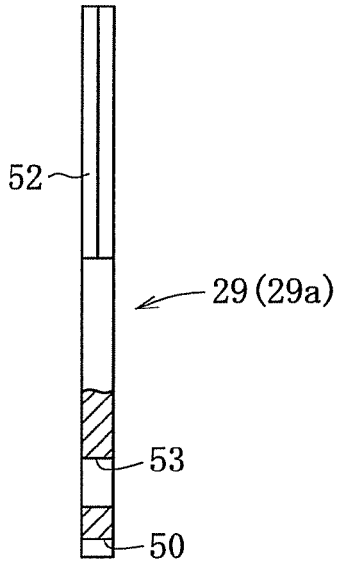
FIG. 5 Diagram of a side view of the hammer member of the crusher.
Figure 6:
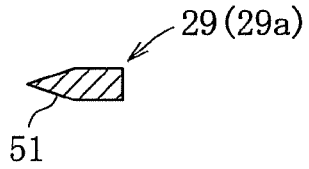
FIG. 6 Diagram of a cross-sectional view taken along line X-X in FIG. 4.

As shown in FIG. 4 to FIG. 6, the hammer member 29 (a first hammer member 29*a*) is a rod-shaped body having a flat, rectangular cross-section, on a base end edge of which a recess 50 is formed. A blade section (crushing blade) 25 is formed on one long edge of the hammer member 29 on the front end side. A through-hole 53 is formed near the recess 50.

A through-hole (not shown) is provided in each circular plate 48. As shown in FIG. 2, in a state in which each first hammer member 29 (29*a*) is sandwiched between the circular plate 48 and the spacer 49, a bolt member (not shown) is inserted through the through-hole in the circular plates 48, the through-hole 53 in the hammer members 29, and the spacer 49 from an outward direction of a circular plate 49 on an outer side. A nut member 55 (see FIG. 1) is screwed onto a threaded end section of the bolt member projecting outward from a circular plate 48 on the other outer side. At this time, the recess 50 formed on the hammer members 29*a* is fitted onto an outer circumferential surface of the rotation shaft 45.

As shown in FIG. 2, a hammer member assembly is configured by four hammer members 29 (29*a*) being arranged along an axial direction of the rotation shaft 45. As shown in FIG. 1, four hammer member assemblies are placed along a circumferential direction at a pitch of 90 degrees.

Support legs 56 and 57 are disposed on both surface sides of the casing 21. End sections of the rotation shaft 45 are supported by the support legs 56 and 57 with bearing members 58 and 59 therebetween, such that the rotation shaft 45 can rotate freely. One end section of the rotation shaft 45 is connected to an output shaft of a driving motor (not shown), with an interlocking mechanism 60 including a belt member therebetween. As a result, when the driving motor is driven, driving force from the driving motor rotates the rotation shaft 45, via the interlocking mechanism 60.

As shown in FIG. 2, each fixed blade 47 is a U-shaped body including a first blade 61, a second blade 62, and a connecting piece 63 that connects the first blade 61 and the second blade 62. A plurality of fixed blades 47 are fixed onto a planar holding plate 64 and a curved holding plate 65 (see FIG. 7 and FIG. 8). In this instance, the planar holding plate 64 is fixed onto a bottom surface of the top wall 31*a* of the casing 21. Each fixed blade 47 (47*a*) fixed onto the planar holding plate 64 is screwed onto the top wall 31*a* of the casing 21 by a bolt member 66 that is inserted into the connecting piece 63 and the planar holding plate 64. The plurality of fixed blades 47 fixed onto the planar holding plate 64 project downward, into the crushing chamber 26. A blade tip 67 of the first blades 61 and the second blades 62 on the top wall 31*a* side face the opening 40 side.

As described above, the hammer members 29 (29*a*) rotate around an axial center of the rotation shaft 45. Therefore, the front end edge of the hammer members 29 follows a circular trajectory during rotation. The curved holding plate 65 is formed into an arc that is a radius of curvature along (facing) the circular trajectory. Plate fitting grooves 66 (see FIG. 13) are formed on the casing 21 along the circular trajectory, on an outer diameter side of the circular trajectory. The curved holding plate 65 is fitted into the plate fitting grooves 66. The plate fitting grooves 66 are curved grooves respectively formed on a front wall 31*b* and a back wall 31*c*.

Figure 7:
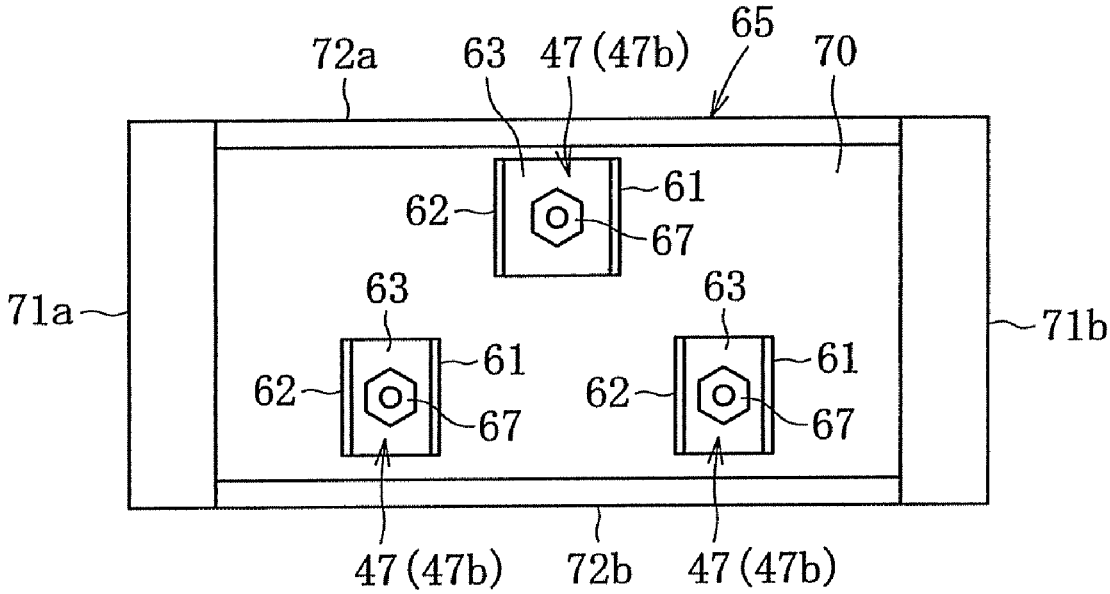
FIG. 7 Diagram of a planar view of cutting blades and a holding plate.
Figure 8:
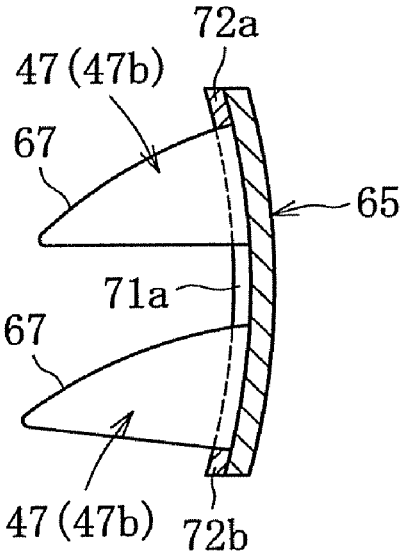
FIG. 8 Diagram of a cross-sectional view of the holding plate holding the cutting blades.

Each connecting piece 63 of the fixed blades 47 (47*b*) attached to the curved holding plate 65 is also fixed onto the curved holding plate 65 by a bolt member 67. As shown in FIG. 6 and FIG. 7, the curved holding plate 65 includes a base plate 70, short-edge frames 71*a* and 71*b*, and long-edge frames 72*a* and 72*b*. The short-edge frames 71*a* and 71*b* are disposed on both short-edge sides of an inner surface (surface on the side on which the fixed blades 47 project) of the base plate 70. The long-edge frames 72*a* and 72*b* are disposed on both long-side edges of the inner surface of the base plate 70. One fixed blade 47*b* is disposed on one long-edge frame 72*a* side. Two fixed blades 47*b* are disposed on the other long-edge frame 72*b* side.

Figure 11:
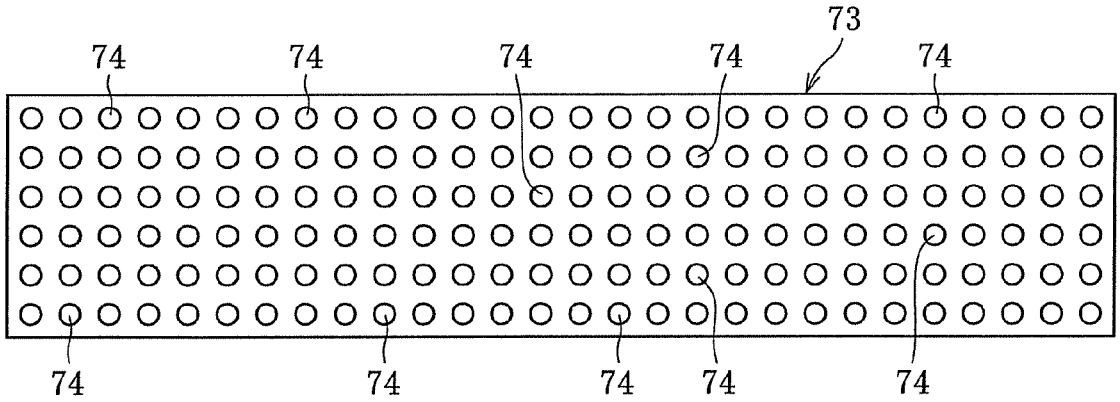
FIG. 11 Diagram of a planar view of a discharge plate.
Figure 12:
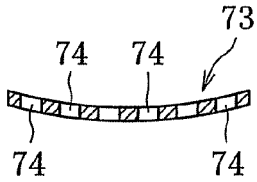
FIG. 12 Diagram of a cross-sectional view of the discharge plate.
Figure 13:
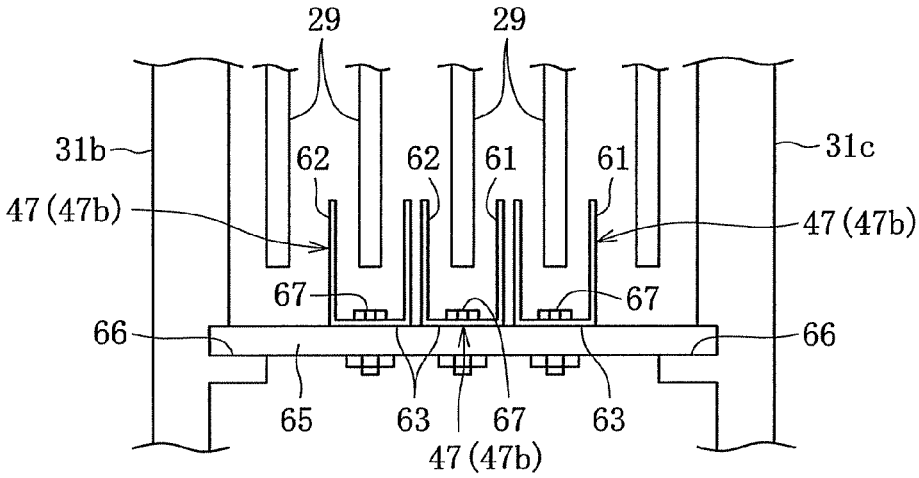
FIG. 13 Simplified diagram of main components.

A pair of curved holding plates 65 is provided. A discharge plate 73, such as that shown in FIG. 11 and FIG. 12, is disposed between the curved holding plates 65. Therefore, the discharge plate 73 is an arc-shaped body corresponding to the circular trajectory of the front end edge of the hammer members 29. Numerous discharge holes (punched holes) 74 are provided in the discharge plate 73. The discharge plate 73 is fitted into the plate fitting grooves 66 and placed below the rotation shaft 45. In other words, the lower discharge opening 23 is formed between the curved holding plates 65. The discharge plate 73 is placed in the lower discharge opening 23.

Figure 9:
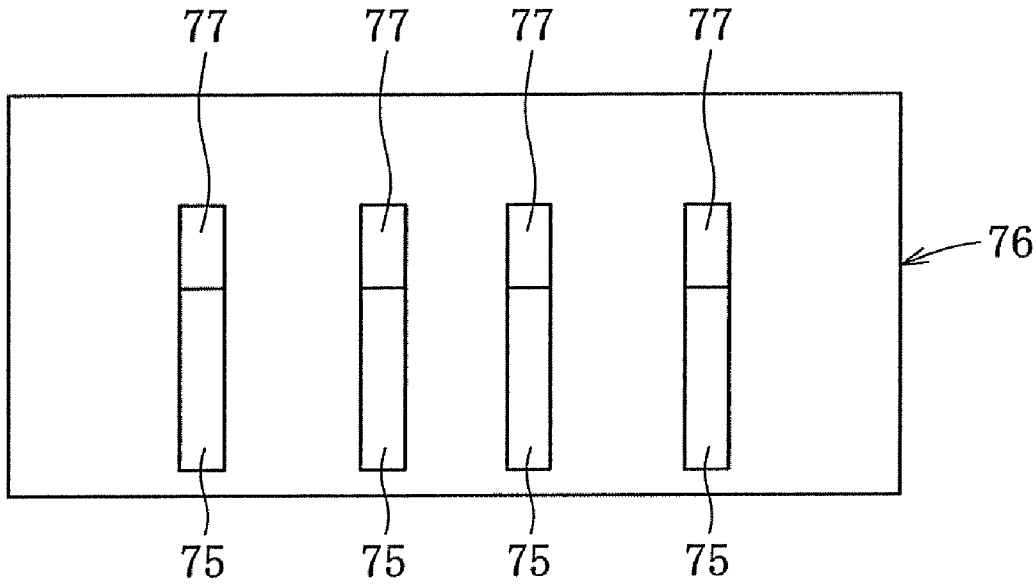
FIG. 9 Diagram of a planar view of guide bodies and a holding plate.
Figure 10:
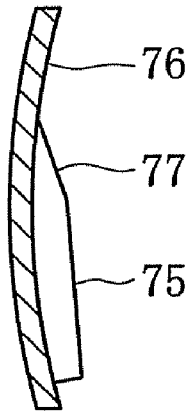
FIG. 10 Diagram of a cross-sectional view of the holding plate holding the guide bodies.

A guide body 75 is disposed on a downstream side (lower side) of the guide path 20, as shown in FIG. 1. The guide body 75 lifts the object to be crushed to the crushing chamber 26 side. As shown in FIG. 9 and FIG. 10, the guide body 75 is integrally fixed onto a curved holding plate 76. In a manner similar to the curved holding plates 65 holding the fixed blades 47, the curved holding plate 76 is formed into an arc that is a radius of curvature along (facing) the circular trajectory of the front end edge of the hammer members 29.

The guide body 75 is a block piece that extends in the width direction of the plate. An angled surface 77 is formed on an upper end edge of the guide body 75. Four guide bodies 75 are arranged on the curved holding plate 76 along the longitudinal direction at a predetermined pitch. The guide bodies 75 are arranged on the downstream side (lower side) of the guide path 20 by the curved holding plate 76 being fitted into the plate grooves 66.

The guide bodies 75, the fixed blades 47*b*, the discharge plate 73, and the fixed blades 47*b* are successively disposed from the downstream side of the guide path 20 towards the opening 40. When the hammer members 29 rotate, the blade section 52 of each hammer member 29 passes between the guide bodies 75 and passes between the first blade 61 and the second blade of the fixed blades 47*a* on the top wall 31*a* side. On the plate fitting groove 66 side, the blade section 52 of three hammer members 29 on the inner side passes between the first blade 61 and the second blade of the fixed blades 47*b*. The blade section 52 of the two hammer members 29 on the outer sides passes through the outer side of the fixed blades 47*b* on the outer sides. In a state in which the pair of curved holding plates 65 is disposed, the blade tip 67 of each fixed blade 47*b* faces the guide body 75 side.

In a front view, the opening 40 forms a rough 120 degree angle. Flange sections 80 and 81 are respectively provided on a vertical direction opening end and an orthogonal direction opening end of the front wall 31*b*. Flange sections 82 and 83 are respectively provided on a vertical direction opening end and an orthogonal direction opening end of the back wall 31*c*. Ribs 84 and 85 are respectively formed on an intermediate section in a vertical direction and a counter-opening end section of the front wall 31*b*.

The lid member 32 includes a front wall 87, a back wall 88, and a peripheral wall 89. A lower end section of the lid member 32 is pivotally connected to the main body 31 of the casing 21 by a hinge section 90, such that the lid member 32 can swing as indicated by arrows C and D. In a front view, the peripheral wall 89 includes a first wall 89*a* that rises from the hinge section 90, a second wall 89*b* that is connected to the first wall 89*a*, a third wall 89*c* that is connected to the second wall 89*b*, and a fourth wall 89*d* that is connected to the third wall 89*c*.

As described above, the front wall 87 is fan-shaped. Flange sections 91 and 92 are respectively provided on a first end surface corresponding to a vertical direction opening end surface of the front wall 31*b* of the casing 21 and a second end wall corresponding to the orthogonal direction opening end of the first wall 31*b* of the casing 21. The back wall 88 is also fan-shaped. Flange sections (not shown) are respectively formed on a first end wall corresponding to a vertical direction opening end surface of the back wall 31*c* of the casing 21 and a second end surface corresponding to the orthogonal direction opening end of the back wall 31*c* of the casing 21.

Therefore, as indicated by solid lines in FIG. 1, the flange sections 91 and 92 of the front wall 87 of the lid member 32 can come into contact with the flange sections 80 and 81 of the front wall 31*b* of the casing 21. The flange sections of the back wall 88 can come into contact with the flange sections 82 and 83 of the back wall 31*c* of the casing 21.

In this way, the lid member 32 is in a closed state when the flange sections are in a contacting state. In the closed state, the opening end on the opening 40 side of the plate fitting grooves 66 is sealed. Each plate 65, 73, and 76 fitted into the plate grooves 66 can be prevented from becoming detached towards the opening side. Detachment of each plate 65, 73, and 76 towards the side counter to the opening is restricted by a counter-opening side end of the plate fitting grooves 66. Therefore, when the lid member 32 is in the closed state, each plate 65, 73, and 76 can be fixed at a fixed position.

A plurality of crushing assisting projections 95 are provided on the inner surface of the peripheral wall 89 of the lid member 32. The crushing assisting projections 95 are bars having a square to rectangular cross-section that extend in a horizontal direction. The crushing assisting projections 95 are arranged on the inner surface of the peripheral wall 89, along the peripheral wall 89 at a predetermined pitch. A handle 99 is provided on the lid member 32 to allow opening and closing operations.

Figure 3A:
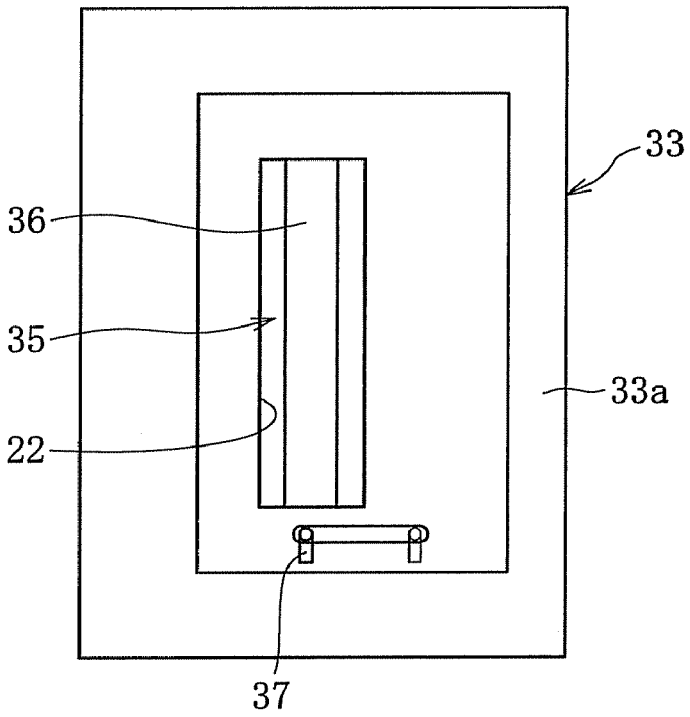
FIG. 3A Diagram of a planar view of an upper loading opening of the crusher when a cassette tape is loaded.
Figure 3B:
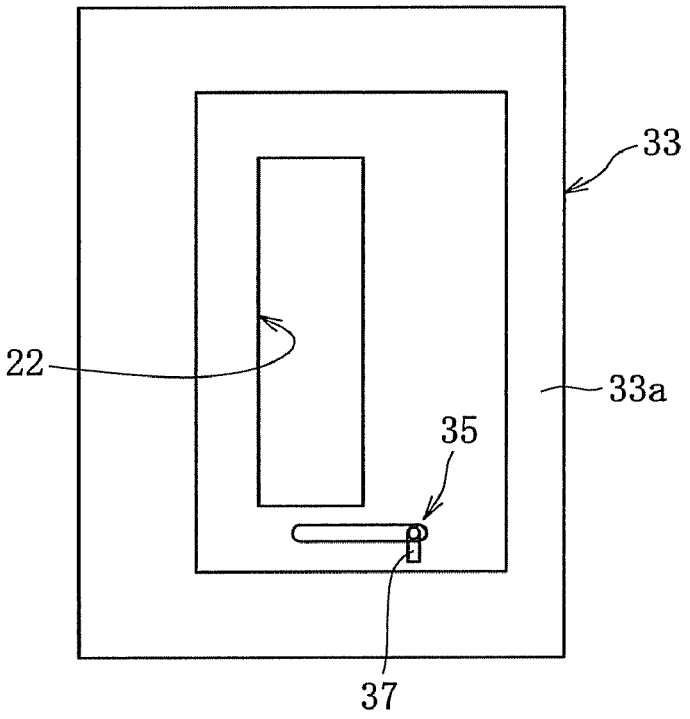
FIG. 3B Diagram of a planar view of the upper loading opening of the crusher when paper is loaded.

Next, a crushing method using the crusher configured as described above will be described. First, when a sheet-shaped object, such as paper, is crushed will be described. In this instance, the shifting means 35 is switched to the state indicated by the phantom lines in FIG. 1 or, in other words, a state in which the loading opening 22 is completely open, as shown in FIG. 3*b*. In this state, the sheet-shaped object to be crushed is loaded from the loading opening 22. As a result of the sheet-shaped object being loaded, the sheet-shaped object enters the crushing chamber 26 along the angled surface 20*a* of the guide path 20. At this time, the rotation shaft 45 is rotated, and the hammer members 29 are rotated in a direction indicated by arrow A in FIG. 1.

Immediately before the object to be crushed enters the crushing chamber 26, the object to be crushed is lifted towards the crushing chamber 26 side by the guide bodies 75 provided on the downstream side of the loading opening 22. In other words, the sheet-shaped object that descends along the angled surface 20*a* is guided by the angled surface 77 of the guide bodies 75 and lifted from the angled surface 20*a*. Therefore, the rotating hammer members 29 strike the sheet-shaped object and cut the sheet-shaped object with the blade tips. The hammer members 29 catch the cut pieces. The fixed blades 47*b* on the lower discharge opening side and the fixed blades 47*a* on the top wall 31*a* side perform operations such as further cutting the cut pieces into smaller pieces, and releasing the cut pieces.

The front end edges of the hammer members 29 pass near the crushing assisting projections 95 on the lid member 32. The cut pieces are mashed by the front end edges of the hammer members 29 and the crushing assisting projections 95, and become a crushed object. The crushed object is discharged from the discharge holes 74 in the discharge plate 73 provided in the lower discharge opening 23 into a product chamber (not shown) disposed in a lower section of the casing 21. The product chamber is in a vacuum state by a suction device (not shown) In other words, because the product chamber is in the vacuum state, the object to be crushed that is loaded into the upper loading opening 22 is suctioned into the crushing chamber 26, crushed in the crushing chamber 26, and the crushed object is discharged into the product chamber. The crushed object is also compressed in the product chamber.

When the object to be crushed is a plastic block object, such as a magnetic tape recording medium like a cassette tape, the position of the shifting plate 36 of the shifting means 35 is switched to the state indicated by the broken lines in FIG. 1. In this instance, the shifting plate 36 is visible from the loading opening 22, as shown in FIG. 3A. The plastic block object is loaded into the loading opening 22 in this state. As a result, the plastic block object is guided by the angled surface 41 and enters the crushing chamber 26.

The plastic block object drops in a roughly vertical direction and enters the crushing chamber 26. In other words, the object to be crushed enters the crushing chamber 26 along a direction of a tangent of the circular trajectory formed by the rotation of the hammer members 29. Therefore, when the object to be crushed enters the crushing chamber 26, the object to be crushed becomes meshed between the hammer members 29. As a result, the object to be crushed does not thrown by the hammer members 29.

The baffle plate 98 made of an elastic material, such as rubber or resin, hangs from the top wall 31*a* of the casing main body 31. Therefore, even should the object to be crushed be thrown, the object to be crushed is returned to the crushing chamber by the baffle plate 98.

Therefore, even when the object to be crushed is a plastic block object, such as a cassette tape, in a manner similar to the above-described sheet-shaped object, the rotating hammer members 29 strike the object to be crushed and cut the object to be crushed with the blade tips. The hammer members 29 catch the cut pieces. The fixed blades 47*b* on the lower discharge opening side and the fixed blades 47*a* on the top wall 31*a* side perform operations such as further cutting the cut pieces into smaller pieces, and releasing the cut pieces. Furthermore, the cut pieces are mashed by the front end edges of the hammer members 29 and the crushing assisting projections 95, and become the crushed object. Because the product chamber is in the vacuum state, the object to be crushed that is loaded into the upper loading opening 22 is suctioned into the crushing chamber 26, crushed in the crushing chamber 26, and the crushed object is discharged into the product chamber.

In the above-described crusher, the object to be crushed can be lifted towards the crushing chamber 26 side by the guide bodies 75 provided on the downstream side of the guide path 20, allowing the object to be crushed to come into contact with the hammer members 29. In other words, the object to be crushed no longer attaches itself to the inner surface of the crushing chamber 26. Therefore, the object to be crushed can be stably crushed.

Because the crushed object is discharged outside (below) from the discharge holes 74 in the discharge plate 73, crushed objects larger than the diameter of the discharge holes 74 are not discharged. The crushed object remains in the crushing chamber 26 and are further crushed by the hammer members 29 and the fixed blades 47. Therefore, only crushed objects crushed to become smaller than the hole diameter of the discharge holes 74 are allowed to be discharged outside. Moreover, because the fixed blades 47 and the guide bodies 75 are respectively attached to the curbed holding plates 65 and 76, handleability of the fixed blades 47 and the guide bodies 75 is excellent.

Because the curved holding plates 65 and 76 on which the fixed blades 47 and the guide bodies 75 are respectively mounted are fitted into the plate fitting grooves 66 of the casing 21, the discharge plate 73, and the plates 65 and 76 including the fixed blades 47 and the guide bodies 75 can be mounted on the casing 21. The fixed blades 47, the guide bodies 75 and the like can be easily set. Moreover, mounting operations of the plates 65 and 76 can be performed through the opening 40 provided in the casing 21. Each plate 65 and 76 attached to the plate fitting grooves 66 can be fixed by the opening 40 being in the closed state by the lid member 32.

Therefore, the fixed blades 47, the guide bodies 75, and the like can be set at fixed positions as follows. The curved holding plates 65 and 76, on which the fixed blades 47 and the guide bodies 75 are respectively mounted, is fitted into the plate fitting grooves 66 on the casing 21 while the opening 40 is in an open state. Then, the lid member 32 is placed in the closed state. When the lid member 32 is placed in an open state from a set state, the each plate 65 and 76 is released from the fixed state. The discharge plate 73, and the plates 65 and 76 including the fixed blades 47 and the guiding bodies 75 can be removed.

Therefore, maintenance and replacing operations of the fixed blades 47, the guide bodies 75, and the like can be performed in a short amount of time and with certainty. The crusher can be used stably over a long period of time, contributing to reduction in running costs.

The shifting means 35 can shift the loading direction into the crushing chamber 26 based on the type of object to the crushed that is loaded into the loading opening 22. Therefore, various types of objects to be crushed can be handled by a single crusher. Significant cost reduction can be achieved.

Because the object to be crushed is crushed by the hammer members 29 and the fixed blades 47, crushing can be performed regardless of whether the object to be crushed is soft paper, such as an account book, or a hard substrate. Recording media storing various pieces of information (such as personal information) can be crushed to a non-reproducible state. Moreover, when paper is shredded by an existing shredder, fibers in the paper are finely cut, resulting in poor recyclability. However, when paper is crushed by the crusher of the present invention, the fibers in the paper remain relatively intact. Therefore, recyclability is excellent.

Figure 14:
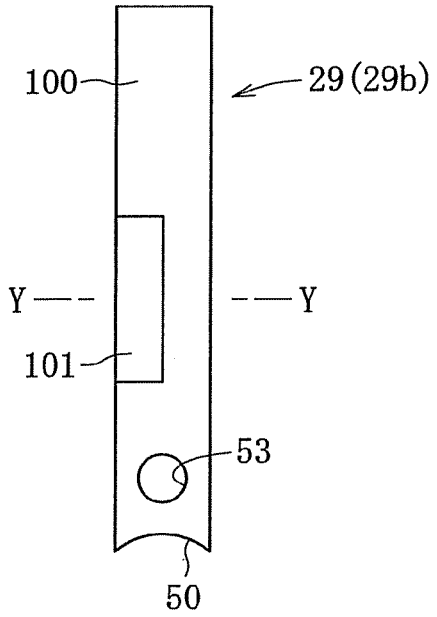
FIG. 14 Diagram of a front view of another hammer member.
Figure 15:
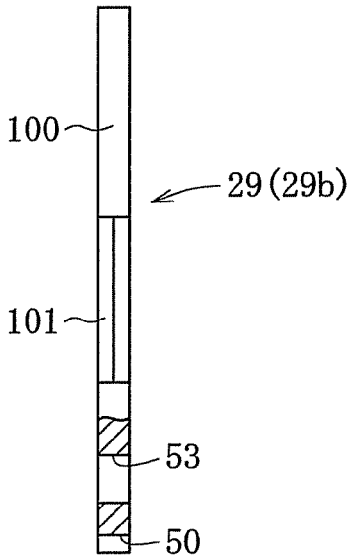
FIG. 15 Diagram of a side view of the other hammer member.
Figure 16:
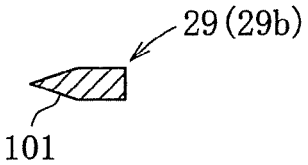
FIG. 16 Diagram of a cross-sectional view taken along line Y-Y in FIG. 14.
Figure 17:
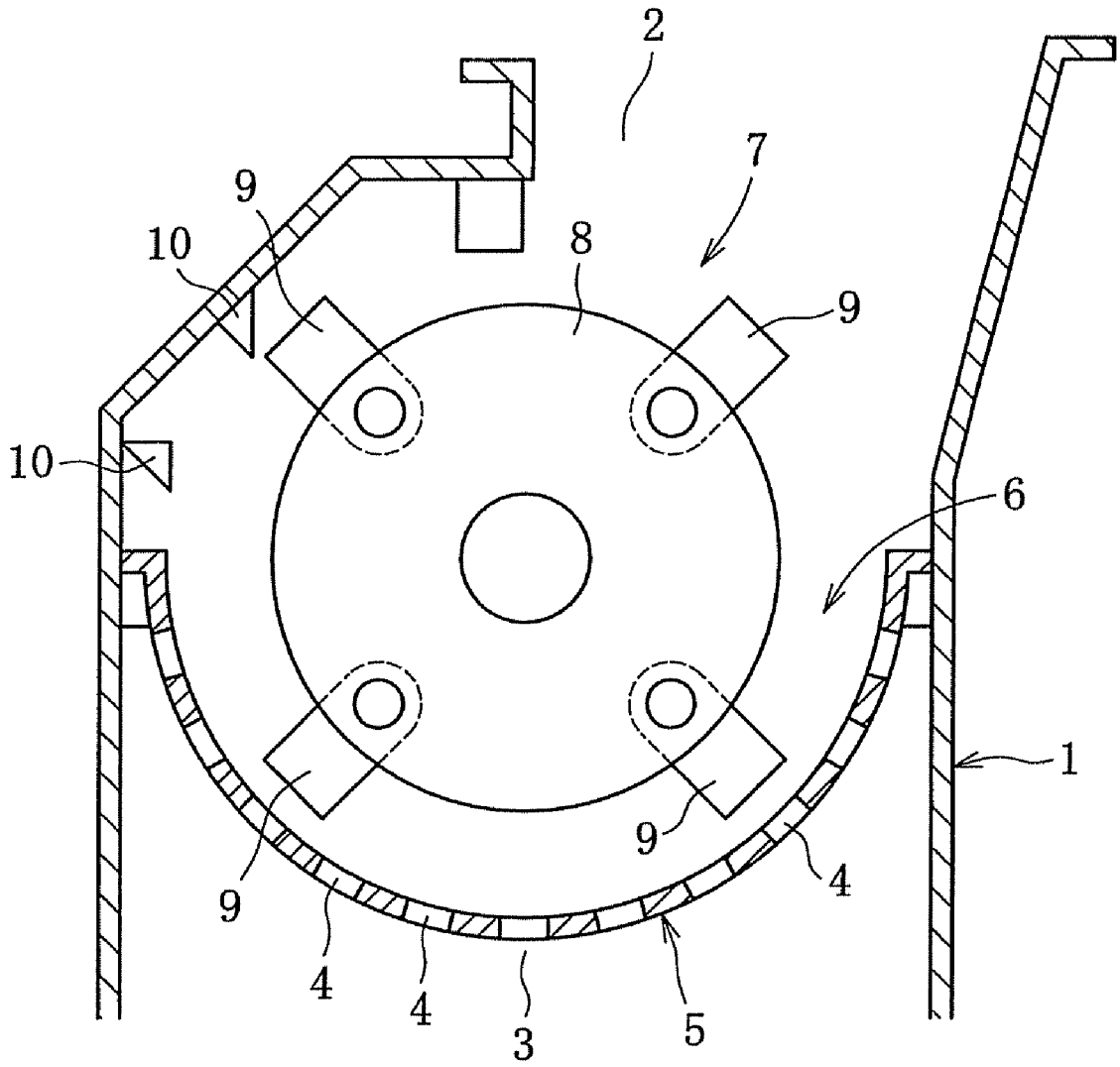
FIG. 17 Diagram of a cross-sectional view of a conventional crusher.

The hammer member 29 can be that shown in FIG. 14 to FIG. 16. In this instance, a hammer member (second hammer member) 29*b* has a planar hammer section 100 on a front end side and a crushing blade 101 in the center. The recess 50 that fits onto the outer circumferential surface of the rotating shaft 45 is also formed on the base end edge of the hammer member 29*b*, in addition to the through-hole 53 for attaching the hammer member 29*b* provided near the recess 50.

Therefore, the hammer members 29*b* can also be easily attached to the rotation shaft 45 in a short amount of time. The hammer members 29*b* can rotate integrally with the rotation shaft 45. In particular, as a result of the hammer members 29*b* being used, the planar hammer section 100 on the front end side can strike the object to be crushed, shredding the object. Tape and the like that becomes tangled with the hammer members 29*b* in the center of the crushing chamber 26 can be cut (shorn).

Therefore, the hammer member 29*b* shown in FIG. 14 to FIG. 16 is optimal for crushing cassette tapes. The hammer member 29*a* shown in FIG. 4 to FIG. 6 can also crush cassette tapes. The hammer member 29*b* shown in FIG. 14 to FIG. 16 can also crush paper.

Each hammer member 29*a* and 29*b* can be easily attached and detached in a short amount of time. Therefore, the hammer member 29*b* shown in FIG. 14 and the like and the hammer member 29*a* shown in FIG. 4 and the like can be provided. The hammer members 29 can be interchanged based on the object to be crushed.

As a result of a plurality of types of hammer members 29 being provided, hammer members 29 can be interchanged based on the type of object to the crushed. The optimal hammer member 29 can be used to crush the object to be crushed. Crushing precision of the crusher is enhanced.

In this way, in the crusher, the object to be crushed can be various objects, such as substrates (substrates mounted on an electrical component and the like), magnetic tape recording media including cassette tapes, optical recording media, and paper. In other words, a single crusher can crush objects ranging from hard objects (such as substrates) to soft objects (such as paper). Therefore, although the crusher to be used is conventionally selected based on the material, shape, hardness and the like of the loaded object to be crushed that is loaded, a single crusher can perform crushing for a wide range of purposes, from hard objects to soft objects, when the crusher of the present invention is used. Therefore, equipment cost can be reduced and running costs can be reduced, thereby reducing overall processing costs. Moreover, excellent protection of personal information and recyclability can be achieved.

An embodiment of the present invention is described above. However, the present invention is not limited to the above-described embodiment. Various modifications can be made. For example, according to the embodiment, the number of hammer member assemblies and the number of hammer members 29 in each hammer member assembly can be arbitrarily increased and decreased. The number of fixed blades 47 arranged on a single plate 64 and plate 65 can also be arbitrarily increased and decreased. Moreover, the number of plates 65 fitted into the plate fitting grooves 66 and the circumferential direction length of the plate 65 can be arbitrarily set.

Discharge holes can also be provided on the plate 65 on which the fixed blades 47 are fixed. The crushed object can be discharged from the discharge holes into the product chamber (crushed object storage chamber). The discharge holes in this instance and the discharge holes 74 in the discharge plate are not limited to circular holes. Elliptical holes, triangular holes, rectangular holes, and the like can be used. Slit-shaped holes and the like can also be used.

According to the embodiment, the crushing assisting projections 95 are arranged on the lid member 32. However, the crushing assisting projections 95 can be omitted. Alternatively, the fixed blades 47 can be placed instead of the crushing assisting projections 95.

Moreover, rotation frequency of the hammer members 29 can be changed based on the type of object to be crushed and the like. The rotation frequency can be changed between the initial stage of crushing and the final stage of crushing. In this instance, the rotation frequency can be slow at the initial stage of crushing, subsequently becoming gradually faster. Alternatively, the hammer members 29 can operate for a predetermined amount of time at a low speed at the initial stage of crushing, subsequently switching to a medium speed. The hammer members 29 can then operate for a predetermined amount of time at the medium speed, subsequently switching to a high speed. The hammer members 29 can then operate for a predetermined amount of time at the high speed.

INDUSTRIAL APPLICABILITY

As a result of the object to be crushed being loaded into the loading opening, the object to be crushed, such as paper, magnetic tape recording media including cassette tapes, optical recording media, and substrates, is lifted by the guiding bodies without attaching itself to the inner surface of the crushing chamber. The object to be crushed is then crushed by the hammer members.

The invention claimed is:

1. A crusher in which hammer members that extend from a rotation shaft in a radial direction and rotate with a rotation of the rotation shaft are housed in a casing that includes an upper loading opening for loading an object to be crushed and a lower discharge opening for discharging a crushed object, fixed blades are arranged within the casing on an outer diameter side of the hammer members, and the hammer members and the fixed blades crush the object to be crushed when the hammer members are rotated, wherein:

the casing comprises a curved surface, and a front wall and a back wall respectively configured at two ends of the curved surface, an opening is configured on the curved surface between the front wall and the back wall, plate fitting grooves are respectively formed on the front wall and the back wall of the casing and extended along a circular arc on the front wall and the back wall, respectively, the circular arc corresponding to a circular trajectory of a front end edge of the hammer members during a rotation of the hammer members in the casing, the opening that can be opened and closed by opening and closing operations of a lid member, and the fixed blades are attached to a curved holding plate, and the curved holding plate is fitted into the plate fitting grooves from the opening, and the plate fitting grooves at the opening are sealed by the closing operation of the lid member and the curve holding plate is thereby prevented from detaching from the plate fitting grooves, while the plate fitting grooves at the opening are exposed by the opening operation of the lid member and the curve holding plate is thereby removable from the plate fitting grooves.

2. The crusher according to claim 1, wherein:

a guide path that guides the object to be crushed that is loaded from the upper loading opening into a crushing chamber in which the object to be crushed is crushed by the hammer members and the fixed blades is provided within the casing, and guide bodies that lift the object to be crushed towards the crushing chamber side are provided on a downstream side of the guide path.

3. The crusher according to claim 2, wherein:

an opening that can be opened and closed by opening and closing operations of a lid member and plate fitting grooves formed along a circular arc surface corresponding to a circular trajectory followed by a front end edge of the hammer members during rotation are formed on the casing, and the guide bodies are attached to a curved holding plate, and the curved holding plate is fitted into the plate fitting grooves from the opening.

4. The crusher according to claim 1, wherein a curved discharge plate including numerous holes for discharging the crushed object is fitted into the plate fitting grooves, and the curved discharge plate is placed in the lower discharge opening.

5. The crusher according to any one of claim 1, wherein each plate fitted into the plate fitting grooves are fixed in a fixed position when the opening in the casing is in a closed state by the lid member.

6. The crusher according to any one of claim 1, wherein a plurality of crushing assisting projections are provided on an inner surface of the lid member.

7. The crusher according to any one of claim 1, wherein a hammer member includes at least a first hammer member having a crushing blade on a front end side and a second hammer member having a planar hammer section on a front end side and a crushing blade in the center, and the first hammer member and the second hammer member can be selectively attached based on a type of object to be crushed.

8. A crusher in which hammer members that extend from a rotation shaft in a radial direction and rotate with a rotation of the rotation shaft are housed in a casing that includes an upper loading opening for loading an object to be crushed and a lower discharge opening for discharging a crushed object, fixed blades are arranged within the casing on an outer diameter side of the hammer members, and the hammer members and the fixed blades crush the object to be crushed when the hammer members are rotated, wherein:

an opening that can be opened and closed by opening and closing operations of a lid member and plate fitting grooves respectively formed on a front wall and a back wall of the casing and extended along a circular arc on the front wall and the back wall, respectively, the circular arc corresponding to a circular trajectory of a front end edge of the hammer members during a rotation of the hammer members in the casing, and a curved holding plate comprises a first plate for attaching the fixed blades, a second plate having a guide body that lifts the object to be crushed to a crushing chamber within the casing and a third plate having a plurality of discharge holes for discharging the object that has been crushed, and the curved holding plate is fitted into the plate fitting grooves from the opening.

9. A crusher in which hammer members that extend from a rotation shaft in a radial direction and rotate with a rotation of the rotation shaft are housed in a casing that includes an upper loading opening for loading an object to be crushed and a lower discharge opening for discharging a crushed object, fixed blades are arranged within the casing on an outer diameter side of the hammer members, and the hammer members and the fixed blades crush the object to be crushed when the hammer members are rotated, wherein:

the casing comprises a curved surface, and a front wall and a back wall respectively configured at two ends of the curved surface, an opening is configured on the curved surface between the front wall and the back wall, plate fitting grooves are respectively formed on the front wall and the back wall of the casing and extended along a circular arc on the front wall and the back wall, respectively, the circular arc corresponding to a circular trajectory of a front end edge of the hammer members during a rotation of the hammer members in the casing, the opening can be opened and closed by opening and closing operations of a lid member, and the fixed blades are attached to a curved holding plate, and the curved holding plate is fitted into the plate fitting grooves from the opening.

* * * * *